US008319722B2

(12) United States Patent
Kim et al.

(10) Patent No.: US 8,319,722 B2
(45) Date of Patent: Nov. 27, 2012

(54) BACKLIGHT UNIT FOR LIQUID CRYSTAL DISPLAY DEVICE AND DRIVING METHOD DRIVING THE SAME

(75) Inventors: Hong-Suk Kim, Seoul (KR); Jun-Hyeok Yang, Goyang-si (KR); Jae-Hong Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 316 days.

(21) Appl. No.: 12/654,070

(22) Filed: Dec. 9, 2009

(65) Prior Publication Data

US 2010/0207535 A1 Aug. 19, 2010

(30) Foreign Application Priority Data

Feb. 19, 2009 (KR) ..... 10-2009-0013981

(51) Int. Cl.
*G09G 3/36* (2006.01)
*H05B 37/02* (2006.01)

(52) U.S. Cl. ..... 345/102; 315/210; 315/287; 315/307

(58) Field of Classification Search ..... 315/210, 315/287, 307; 345/102
See application file for complete search history.

(56) References Cited

U.S. PATENT DOCUMENTS

| | | | | |
|---|---|---|---|---|
| 5,844,540 | A * | 12/1998 | Terasaki | 345/102 |
| 2004/0056825 | A1* | 3/2004 | Min et al. | 345/38 |
| 2004/0183821 | A1* | 9/2004 | Woo | 345/691 |
| 2005/0140639 | A1* | 6/2005 | Oh et al. | 345/102 |
| 2007/0296673 | A1* | 12/2007 | Kang et al. | 345/92 |
| 2009/0147176 | A1* | 6/2009 | Kron et al. | 349/61 |
| 2009/0201244 | A1* | 8/2009 | Park et al. | 345/102 |
| 2009/0243506 | A1* | 10/2009 | Bremer et al. | 315/287 |

* cited by examiner

*Primary Examiner* — Douglas W Owens
*Assistant Examiner* — Thai Pham
(74) *Attorney, Agent, or Firm* — McKenna Long & Aldridge, LLP

(57) ABSTRACT

A backlight unit for a liquid crystal display device includes: at least one light source; and an inverter circuit part including a dimming test portion generating a dimming signal and turning ON/OFF the at least one light source using the dimming signal.

13 Claims, 5 Drawing Sheets first dimming patterm second dimming patterm

BACKLIGHT UNIT FOR LIQUID CRYSTAL DISPLAY DEVICE AND DRIVING METHOD DRIVING THE SAME

This application claims the benefit of Korean Patent Application No. 2009-0013981 filed on Feb. 19, 2009, which is hereby incorporated by reference in its entirety for all purposes.

BACKGROUND OF THE INVENTION

1. Field of the Invention

The present application relates to a backlight unit for a liquid crystal display device, and more particularly, to a backlight unit having a dimming test portion and a method of driving the backlight unit.

2. Discussion of the Related Art

Liquid crystal display (LCD) devices having thin profiles, light weight, and low power consumption have been used in notebook computers, office automation devices, audio/video devices, and the like. Among the various types of LCD devices, active matrix LCD (AM-LCD) devices that employ switching elements and pixel electrodes arranged in a matrix structure are the subject of significant research and development because of their high resolution and superior suitability for displaying moving images. Thin film transistor LCD (TFT-LCD) devices use thin film transistors (TFTs) as the switching elements.

An LCD device includes a liquid crystal panel having switching elements and a backlight unit supplying light to the liquid crystal panel. A cold cathode fluorescent lamp (CCFL) has been used as a light source in the backlight unit. As the backlight unit is required to have a small size, a thin profile and a light weight, a light emitting diode (LED) having advantages in a power consumption, a weight and a brightness has been suggested as a light source for the backlight unit. In addition, a dimming test is performed for the LCD device to verify a normal operation of the LEDs in the backlight unit.

FIGS. 1 to 3 are views showing dimming tests for a backlight unit of a liquid crystal display device according to the related art.

In FIG. 1, a liquid crystal display (LCD) device 1 includes a control circuit part 5 and a backlight unit 10. The control circuit part 5 may be formed on a printed circuit board (PCB). The backlight unit 10 includes a plurality of light emitting diodes (LEDs) 16 and first and second inverter circuit parts 12 and 14. The control circuit part 5 supplies a dimming signal to first and second inverter circuit parts 12 and 14, and the first and second inverter circuit parts 12 and 14 control the plurality of LEDs 16 using the dimming signal, thereby performing a dimming test.

In FIG. 2, the LCD device 1 is connected to an external circuit 20 of a display system (not shown) such as a television set. The external circuit 20 supplies a dimming signal to the first and second inverter circuit parts 12 and 14, and the first and second inverter circuit parts 12 and 14 control the plurality of LEDs 16 using the dimming signal, thereby performing a dimming test.

In FIG. 3, the LCD device 1 is connected to a test apparatus 20. The test apparatus 20 supplies a dimming signal to the first and second inverter circuit parts 12 and 14, and the first and second inverter circuit parts 12 and 14 control the plurality of LEDs 16 using the dimming signal, thereby performing a dimming test.

In the dimming tests of FIGS. 1 to 2, since the backlight unit 10 receives the dimming signal from the control circuit part 5 of the LCD device 1 or the external circuit 20 of the display system, the dimming test is performed after the backlight unit 10 is assembled with the LCD device 1 or the display system. Accordingly, when abnormal operation of the LEDs 16 in the backlight unit 10 is detected through the dimming test, the LCD device 1 including the backlight unit 10 or the display system including the backlight unit 10 should be abolished or disassembled for rework. Further, in the dimming test of FIG. 3, an additional apparatus such as the test apparatus 20 is required, fabrication cost increases.

SUMMARY OF THE INVENTION

Accordingly, the present invention is directed to a backlight unit for a liquid crystal display device that substantially obviates one or more of the problems due to limitations and disadvantages of the related art.

An object of the present invention is to provide a backlight unit generating a dimming signal for a dimming test of a liquid crystal display device and a method of driving the backlight unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a backlight unit for a liquid crystal display device includes: at least one light source; and an inverter circuit part including a dimming test portion generating a dimming signal and turning ON/OFF the at least one light source using the dimming signal.

In another aspect, a method of driving a backlight unit for a liquid crystal display device includes: providing a control signal to an inverter circuit part of the backlight unit during a first time period; adjusting the inverter circuit part according to the control signal such that at least one light source of the backlight unit displays a first dimming pattern during the first time period; turning OFF the at least one light source during a second time period; providing the control signal to the inverter circuit part during a third time period; and adjusting the inverter circuit part according to the control signal such that the at least one light source displays a second dimming pattern during the third time period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings. Wherever possible, similar reference numbers will be used to refer to the same or similar parts.

Figure 1:
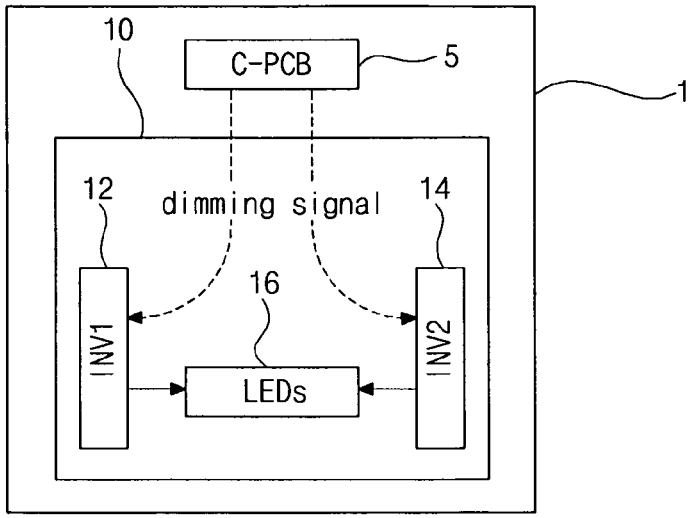
(related art) FIG. 1
FIGS. 1 to 3 are views showing dimming tests for a backlight unit of a liquid crystal display device according to the related art.
Figure 2:
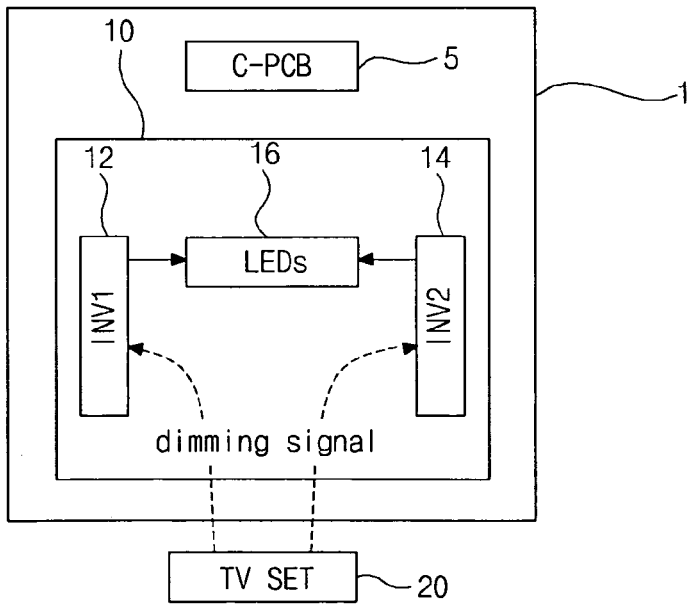
(related art) FIG. 2
Figure 3:
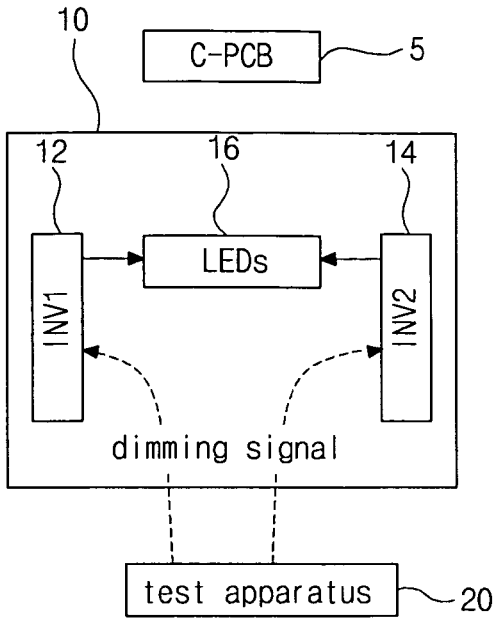
(related art) FIG.3
Figure 4:
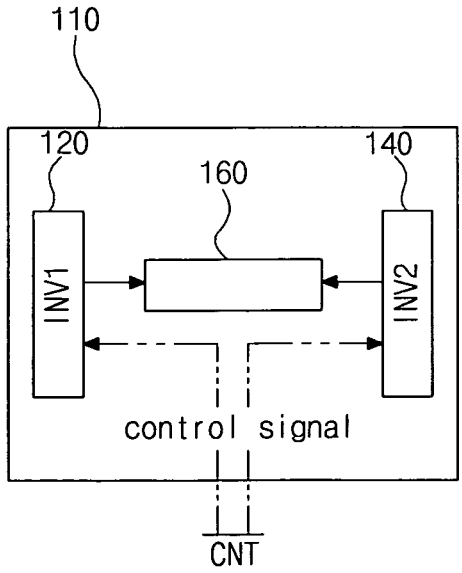
FIG. 4 is a view showing a backlight unit for a liquid crystal display device according to an embodiment of the present invention.
Figure 5:
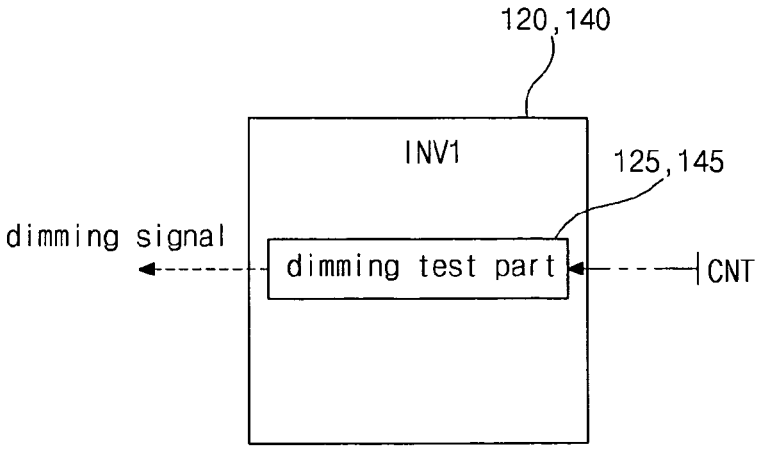
FIG. 5 is a view showing each of first and second inverter circuit parts of a backlight unit according to an embodiment of the present invention.

FIG. 4 is a view showing a backlight unit for a liquid crystal display device according to an embodiment of the present invention, and FIG. 5 is a view showing each of first and second inverter circuit parts of a backlight unit according to an embodiment of the present invention.

In FIG. 4, a backlight unit 110 includes a plurality of light emitting diodes (LEDs) 160, and first and second inverter circuit parts 120 and 140 controlling the plurality of LEDs 160. In another embodiment, a backlight unit 110 may include a plurality of inverter circuit parts.

The backlight unit 110 provides a function for a dimming test. Accordingly, each of the first and second inverter circuit parts 120 and 140 generates a dimming signal for the dimming test according to a control signal CNT from exterior and controls the plurality of LEDs 160 using the dimming signal.

As shown in FIG. 5, each of the first and second inverter circuit parts 120 and 130 includes a dimming test portion 125 and 145, which is a kind of logic. The dimming test portion 125 and 145 generates the dimming signal according to the control signal CNT, and each of the first and second inverter circuit parts 120 and 140 turns ON/OFF the plurality of LEDs 160 to display a dimming pattern corresponding to the dimming signal. Accordingly, the dimming test portion 125 and 145 adjusts each of the first and second inverter circuit parts 120 and 140 to supply an ON signal to predetermined ones among the plurality of LEDs 160 according to the control signal CNT.

In the backlight unit 110 of the present invention, the dimming signal for the dimming test is not supplied by an external part. Instead, the dimming signal for the dimming test is generated in the backlight unit 110 according to the control signal CNT and the dimming test is performed using the dimming signal such that the plurality of LEDs 160 are turned ON/OFF to display the dimming pattern corresponding to the dimming signal.

The control signal CNT may be provided by an operator. For example, the operator may provide a control voltage corresponding to the control signal CNT to the first and second inverter circuit parts 120 and 140 using a DIP switch or a computer, and the first and second inverter circuit parts 120 and 140 may turn ON/OFF the plurality of LEDs 160 using the dimming signal generated in the dimming test portion 125 and 145 according to the control voltage. That is, each of the first and second inverter circuit parts 120 and 140 may be formed as an integrated circuit (IC) having a plurality of input terminals, and some of the plurality of input terminals may be assigned for the dimming test portion 125 and 145. In addition, the operator may provide the control voltage corresponding to the control signal to the first and second dimming test portion 125 and 145 through the assigned input terminals, and the dimming test may be performed by turning ON/OFF the plurality of LEDs 160 using the dimming signal generated in the first and second dimming test portion 125 and 145.

The dimming pattern corresponding to the dimming signal may have various shapes. For example, the dimming pattern may be a check pattern such as a chessboard.

Figure 6:
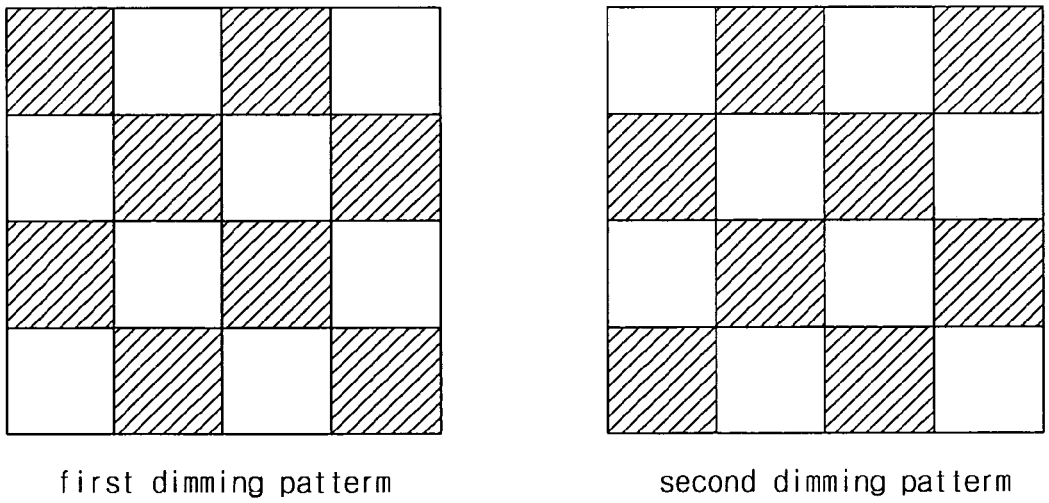
FIG. 6 is a view showing dimming patterns of a backlight unit according to an embodiment of the present invention.
Figure 7:
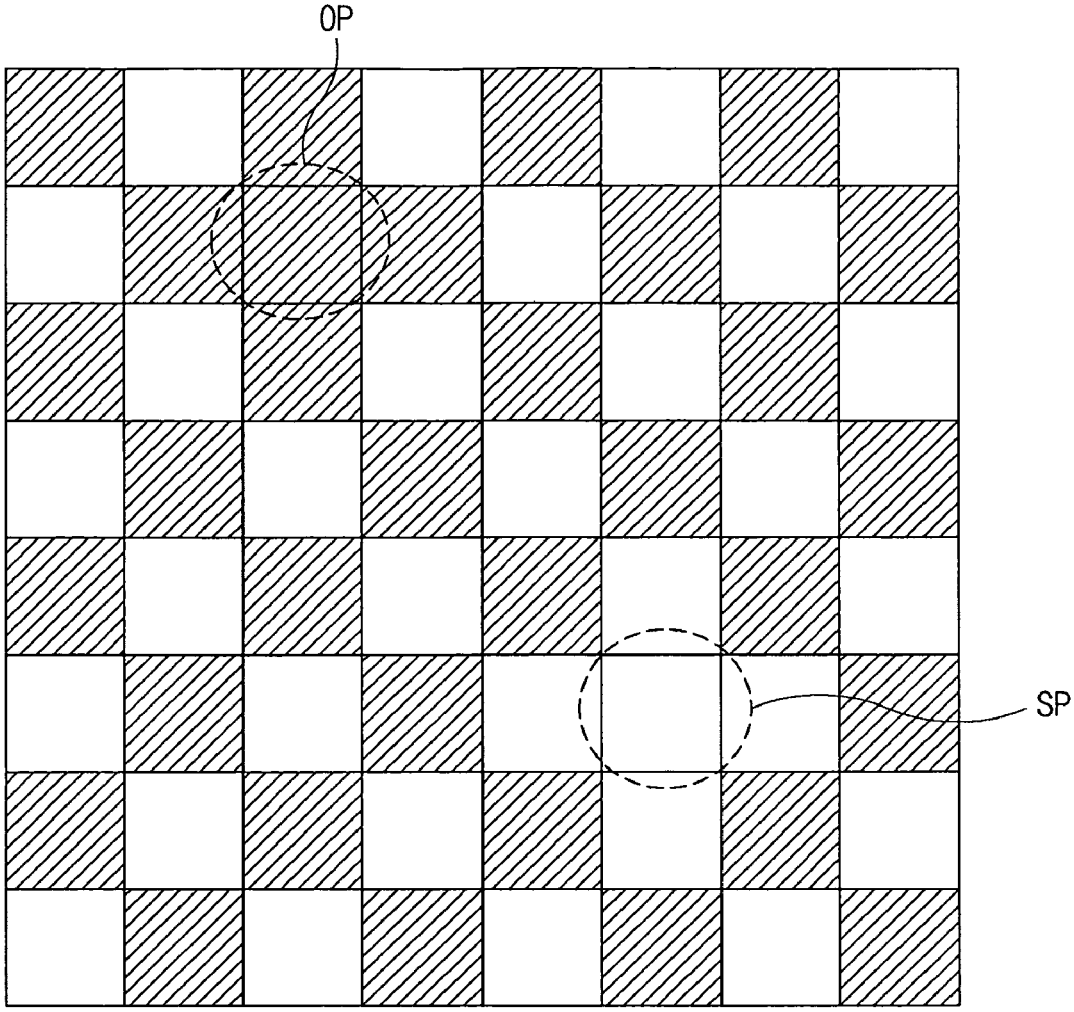
FIG. 7 is a view showing defects in a dimming pattern of a backlight unit according to an embodiment of the present invention.

FIG. 6 is a view showing dimming patterns of a backlight unit according to an embodiment of the present invention, and FIG. 7 is a view showing defects in a dimming pattern of a backlight unit according to an embodiment of the present invention.

In FIG. 6, each of first and second dimming patterns has a check pattern where a black region and a white region are alternately arranged along vertical and horizontal directions. The first and second dimming patterns have opposite brightness to each other at a given point. During the dimming test, the first and second dimming patterns may be alternately displayed by the backlight unit 110.

While the backlight unit 110 displays the first and second dimming patterns, the operator easily detects defects corresponding to an electric connection (short) or an electric disconnection (open) in the first and second dimming patterns with the naked eyes. As shown in FIG. 7, when the dimming pattern has first and second defects OP and SP, the first defect OP may be interpreted as an electric disconnection of the corresponding LED and the second defect SP may be interpreted as an electric connection of the corresponding LED to adjacent LEDs.

Hereinafter, a method of driving the backlight unit 110 for the dimming test will be illustrated.

The first and second inverter circuit parts 120 and 140 are electrically connected to a source of the control signal CNT. For example, when a personal computer is used for the control signal CNT, the computer may be electrically connected to the backlight unit 110. In addition, the computer may have a program for the dimming test and an operator may adjust the computer via a button of a key board such that the computer provides the control signal CNT to the dimming test portion 125 and 145.

Figure 8:
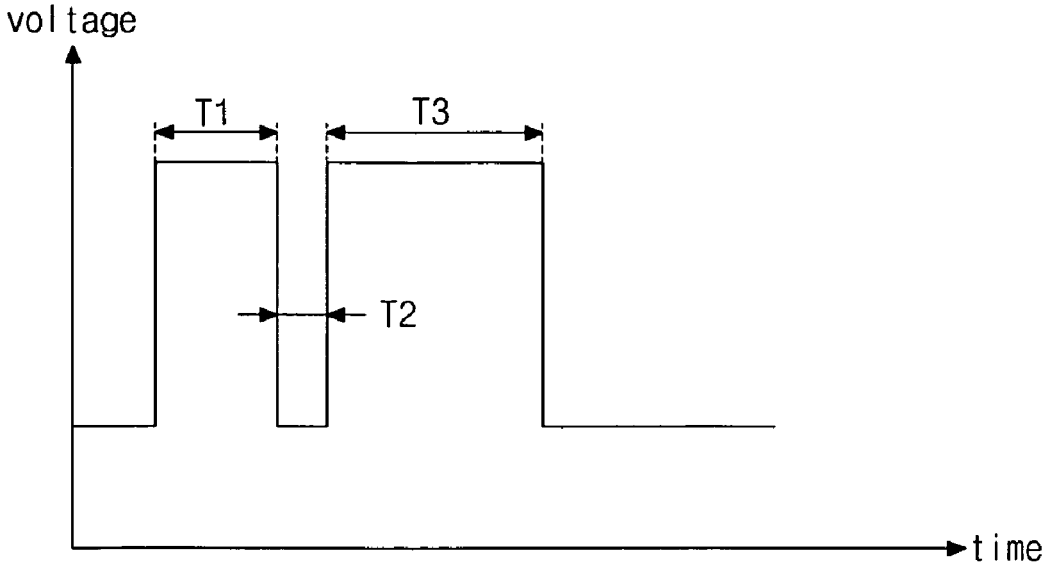
FIG. 8 is a timing chart showing a method of driving a backlight unit according to an embodiment of the present invention.

FIG. 8 is a timing chart showing a method of driving a backlight unit according to an embodiment of the present invention.

In FIG. 8, a control signal CNT is provided to the dimming test portion 125 and 145 (of FIG. 5) during first and third time period T1 and T3, and the control signal CNT is not provided to the dimming test portion 125 and 145 during second time period T2. Accordingly, the control signal CNT is supplied during the first time period T1, is not supplied during the second time period T2, and is supplied again during the third time period T3. When the control signal CNT is supplied again during the third time period T3 after the second time period T2 having no control signal, the dimming test portion 125 and 145 may automatically control the plurality of LEDs to display different dimming pattern.

For example, when an operator pushes a button firstly, the control signal CNT may be initially provided and the backlight unit 110 may be driven to display the first dimming pattern of FIG. 6. In addition, when the operator pushes the button secondly, the provision of the control signal CNT may be stopped and the plurality of LEDs are turned OFF so that the backlight unit 110 can not display any pattern. Further, when the operator pushes the button thirdly, the control signal CNT may be provided again. The difference in timing of the first and second pushes may be determined as the first time period T1, and the difference in timing of the second and third pushes may be determined as the second time period T2.

When the control signal CNT is provided again, the dimming test portion 125 and 145 may detect pause of the control signal CNT during the second time period T2, and may compare the second time period T2 with a predetermined time period. When the second time period T2 is shorter than the predetermined time period, the backlight unit 110 may be driven to display the second dimming pattern of FIG. 6. When the second time period T2 is longer than the predetermined time period, the backlight unit 110 may be driven to display the first dimming pattern of FIG. 6 because the third push is regarded as a push for a new dimming test. Finally, when the operator pushes the button fourthly, the provision of the control signal CNT may be stopped again and the dimming test may be finished. The difference in timing of the third and fourth pushes may be determined as the third time period T3. For example, the first, second and third time periods T1, T2 and T3 may have a different length from each other, and the first and third time periods T1 and T3 may have the same length as each other.

Consequently, since a backlight unit of the present invention generates a dimming signal for a dimming test, the dimming test for the backlight unit including a plurality of LEDs is performed without an external system, and fabrication cost is reduced. In addition, since an external system for providing the control signal is not required, the dimming test is performed for the backlight unit disassembled with the external system such as an LCD device or a display system, and production yield is improved.

It will be apparent to those skilled in the art that various modifications and variations can be made in the backlight unit and the method of driving the backlight unit of the present invention without departing from the spirit or scope of the invention. Thus, it is intended that the present invention cover the modifications and variations of this invention provided they come within the scope of the appended claims and their equivalents.

What is claimed is:

1. A backlight unit for a liquid crystal display device, comprising:

at least one light source; and an inverter circuit part including a dimming test portion generating a dimming signal and turning ON/OFF the at least one light source using the dimming signal, wherein the dimming test portion having a programmed dimming pattern adjusts the inverter circuit part according to only a control signal such that the at least one light source displays the programmed dimming pattern corresponding to the dimming signal, and wherein the backlight unit displays the programmed dimming pattern by turning ON/OFF the at least one light source regionally.

2. The backlight unit according to claim 1, wherein the at least one light source is a plurality of light emitting diodes (LEDs).

3. The backlight unit according to claim 2, wherein the inverter circuit part is formed as an integrated circuit (IC) having a plurality of input terminals.

4. The backlight unit according to claim 3, wherein the control signal is inputted into the dimming test portion through at least one of the plurality of input terminals.

5. The backlight unit according to claim 4, wherein the control signal is provided by a computer.

6. The backlight unit according to claim 3, wherein the programmed dimming pattern includes first and second check patterns having opposite brightness to each other at a predetermined region.

7. A method of driving a backlight unit for a liquid crystal display device, comprising:

providing a control signal to an inverter circuit part of the backlight unit during a first time period;

adjusting the inverter circuit part according to the control signal such that at least one light source of the backlight unit displays a first dimming pattern during the first time period;

turning OFF the at least one light source during a second time period;

providing the control signal to the inverter circuit part during a third time period;

adjusting the inverter circuit part according to the control signal such that the at least one light source displays a second dimming pattern during the third time period; and generating a dimming signal corresponding to the first and second dimming patterns in a dimming test portion of the inverter circuit part, and adjusting the inverter circuit part using the dimming signal to turn ON/OFF the at least one light source, wherein the backlight unit displays the first and second dimming patterns by turning ON/OFF the at least one light source regionally.

8. The method according to claim 7, further comprising pausing the control signal during the second time period.

9. The method according to claim 8, further comprising detecting a pause of the control signal during the second time period, and comparing the second time period with a predetermined time period.

10. The method according to claim 9, wherein the least one light source displays the second dimming pattern different from the first dimming pattern during the third time period when the second time period is shorter than the predetermined time period.

11. The method according to claim 10, wherein the first and second dimming patterns is opposite check patterns having opposite brightness to each other at a predetermined region.

12. The method according to claim 7, wherein the first, second and third time periods have a different length from each other.

13. The method according to claim 7, wherein the first and third time periods have a same length as each other.

* * * * *